US005935044A

United States Patent [19]

Brewster

[11] Patent Number: 5,935,044

[45] Date of Patent: Aug. 10, 1999

[54] METHOD AND APPARATUS FOR SECURING BRASSIERE STRAPS

[76] Inventor: Lorie K. Brewster, 3935 W. Willow Ave., Phoenix, Ariz. 85029

[21] Appl. No.: 08/566,689

[22] Filed: Dec. 4, 1995

[51] Int. Cl.[6] ..... A41C 3/00

[52] U.S. Cl. ..... 480/86; 2/323; 24/545

[58] Field of Search ..... 2/101, 338, 311, 2/310, 312; 450/86; 24/302, 198, 336, 563, 545

[56] References Cited

U.S. PATENT DOCUMENTS

| | | | |
|---|---|---|---|
| 858,473 | 7/1907 | Sanders | 24/545 |
| 1,287,764 | 12/1918 | Sanderson | 24/545 X |
| 1,401,227 | 12/1921 | Wyeth | 2/323 |
| 1,410,306 | 3/1922 | Hoffman | 2/323 |
| 1,478,773 | 12/1923 | Stocker | 2/323 |
| 1,489,731 | 4/1924 | Baldwin | 24/563 |
| 1,769,753 | 7/1930 | Reuter | 24/198 |
| 2,049,660 | 8/1936 | Patten | 24/563 |
| 4,858,249 | 8/1989 | Stewart | 24/306 X |
| 5,024,628 | 6/1991 | Sanchez | 450/86 X |

FOREIGN PATENT DOCUMENTS

| | | | |
|---|---|---|---|
| 702592 | 4/1931 | France | 2/323 |
| 250015 | 9/1926 | Italy | 2/323 |
| 8631 | 8/1900 | Norway | 24/563 |

*Primary Examiner*—Jeanette Chapman
*Attorney, Agent, or Firm*—Tod R. Nissle, P.C.

[57] ABSTRACT

A method and apparatus for securing brassiere straps in a selected position prevents the straps from sliding off the shoulders of the user.

5 Claims, 3 Drawing Sheets

METHOD AND APPARATUS FOR SECURING BRASSIERE STRAPS

This invention relates to brassieres.

More particularly the invention relates to a method and apparatus for securing brassiere straps in a selected position to prevent the straps from sliding off the shoulders of the user.

A problem commonly encountered by women is that the shoulder straps of a brassiere often tend to slide off the shoulders. As a result, a variety of elastic connectors have been developed to hold brassiere shoulder straps in place. Such connectors typically extend across a woman's back intermediate the shoulder straps. One disadvantage of such conventional elastic connectors is that the expansion and contraction of the connectors while contacting the skin of the user tends to chafe and irritate the skin. Another disadvantage is that conventional connectors are often difficult for a woman to put on and adjust alone while wearing a brassiere. Still another disadvantage of conventional connectors is that when a woman has a substantial bosom, the forces generated by her breasts on the brassiere straps tend to distend and deform the connector. Yet another disadvantage is that conventional connectors are not adapted to fit women of differing height and stature.

Accordingly, it would be highly desirable to provide an improved method and apparatus which would maintain brassier shoulder straps in a desired position on the user, which could be easily installed and adjusted by the user on a brassiere while wearing the brassiere, which would minimize irritation of the user's skin, and which could be readily adapted to fit women of different stature.

Therefore, it is a principal object of the invention to provide an improved method and apparatus for securing brassiere shoulder straps in a selected position on the user.

A further object of the invention is to provide an improved method and apparatus which can, while a woman is wearing a brassiere, be implemented by the woman to prevent the brassiere shoulder straps from sliding off her shoulders.

Another object of the invention is to provide an improved apparatus which secures the shoulder straps of a brassiere in fixed position on a user while minimizing irritation to the user's skin.

Still a further object of the invention is to provide an improved apparatus of the type described which automatically slides up and down along brassiere straps to adjust its position to correspond to changes in the posture of the user.

These and other, further and more specific objects and advantages of the invention will be apparent to those skilled in the art from the following detailed description thereof, taken in conjunction with the drawings, in which.

Figure 1:
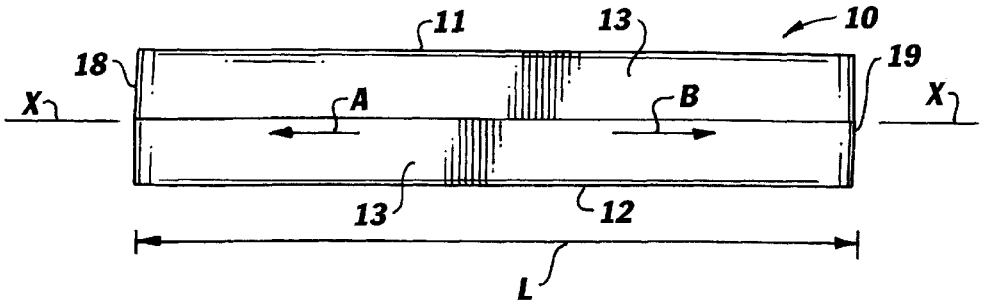
FIG. 1 is a top view illustrating a substantially rigid clip constructed in accordance with the principles of the invention.

Briefly, in accordance with my invention, I provide an improved clip for use with a brassiere. The brassiere includes a primary strap shaped and dimensioned to extend around the torso and having a front portion and a back portion; cups attached to the front portion of the strap and shaped and dimensioned to support the breasts of a woman wearing the brassiere; and, a pair of spaced apart shoulder straps each shaped and dimensioned when the brassiere is worn by the woman to extend from one of the cups over a different one of the shoulders of the woman to the back portion of the primary strap. The improved clip prevents the brassiere shoulder straps from sliding off the shoulders of the woman. The clip includes an elongate body having first and second ends and having a longitudinal axis, the body being substantially rigid and resistant to distension along said longitudinal axis; a first leg attached to the first end of and spaced apart from the body, the leg and body being shaped and dimensioned to form and bound an opening sized to slidably receive one of the shoulder straps of the brassiere; a second leg attached to the second end of the body, the second leg and body being shaped and dimensioned to form and bound an opening sized to slidably receive the other of the shoulder straps of the brassiere.

In another embodiment of my invention, I provide an improved clip for use with a brassiere. The brassiere includes a primary strap shaped and dimensioned to extend around the torso and having a front portion and a back portion; cups attached to the front portion of the strap and shaped and dimensioned to support the breasts of a woman wearing the brassiere; and, a pair of spaced apart shoulder straps each shaped and dimensioned when the brassiere is worn by the woman to extend from one of the cups over a different one of the shoulders of the woman to the back portion of the primary strap. The clip prevents the shoulder straps from sliding off the shoulders of the woman. The clip includes an elongate body having first and second ends and having a longitudinal axis; a first leg attached to the first end of and spaced apart from the body to form and bound a first opening sized to slidably receive one of the shoulder straps of the brassiere; and, a second leg attached to the second end of and spaced apart said body, the second leg and body being shaped and dimensioned to form and bound a second opening sized to slidably receive the other of the shoulder straps of the brassiere. The first and second openings are shaped and dimensioned such that when the clip is mounted on the brassiere with the shoulder straps each extending through a different one of the first and second openings, pulling the shoulder straps apart causes the clip to slide along the shoulder straps.

In a further embodiment of my invention, I provide an improved clip for a brassiere. The brassiere includes a primary strap shaped and dimensioned to extend around the torso and having a front portion and a back portion; cups attached to the front portion of the strap and shaped and dimensioned to support the breasts of a woman wearing the brassiere; and, a pair of spaced apart shoulder straps each shaped and dimensioned when the brassiere is worn by a woman to extend from one of the cups over a different one of the shoulders of the woman to the back portion of the primary strap. The clip prevents the brassiere shoulder straps from sliding off the shoulders of the woman. The clip includes an elongate body having first and second ends, a length, and, a longitudinal axis, the length of the clip being about equal to the flex distance between the shoulder blades of the woman wearing the brassiere; a first leg attached to the first end of and spaced apart from the body to form and bound a first opening sized to receive one of the shoulder straps of the brassiere; and, a second leg attached to the second end of and spaced apart said body. The second leg and body are shaped and dimensioned to form and bound a second opening sized to receive the other of the shoulder straps of the brassiere.

In yet another embodiment of my invention, I provide a clip for a brassiere. The brassiere includes a primary strap shaped and dimensioned to extend around the torso and having a front portion and a back portion; cups attached to the front portion of the strap and shaped and dimensioned to support the breasts of a woman wearing the brassiere; and, a pair of spaced apart shoulder straps each shaped and dimensioned when the brassiere is worn by a woman to extend from one of the cups over a different one of the shoulders of the woman to the back portion of the primary strap. The clip prevents the shoulder straps from sliding off the shoulders of the woman. The clip includes an elongate body having first and second ends, a length, and, a longitudinal axis, a first leg attached to the first end of and spaced apart from the body to form and bound a first opening sized to receive one of the shoulder straps of the brassiere; and, a second leg attached to the second end of and spaced apart from the body, the second leg and body being shaped and dimensioned to form and bound a second opening sized to receive the other of the shoulder straps of the brassiere. The clip is shaped and dimensioned to conform to the contour of the woman's back when worn on the brassiere such that the shoulder straps each extend through a different one of the first and second openings.

Turning now to the drawings, which depict the presently preferred embodiment of the invention for the purpose of illustrating the practice thereof and not by way of limitation of the scope of the invention, FIGS. 1 to 7 illustrate a clip 10 constructed in accordance with the principles of the invention. Clip 10 includes elongate body 30 having an upper surface 13, inner surface 20, front edge 12, back edge 11, and first 18 and second 19 ends. The length of body 30 is indicated by arrows L. Length L preferably corresponds to the flex distance between the shoulder blades of the woman wearing the brassiere on which clip 10 is mounted. The flex distance equals the shortest distance between the woman's shoulder blades when her elbows are pushed straight back along her sides to a flex position in which her forearms are parallel to one another and each elbow is touching a side of the woman above her hips and to one side of her lower back. When the woman places her elbows in such a flex position, it tends to flex or force the shoulder bones toward one another. Body 30 has a longitudinal axis X. Body 30 is substantially rigid such that body 30 will not stretch or distend when tensile forces are applied to body 30 and when such tensile forces are of normal magnitude, are acting in the direction of arrows A and B, and are parallel to axis X. As used herein, tensile forces of a normal magnitude are those which are, when clip 10 is mounted on straps 41 and 42 of a brassiere worn by a woman (FIG. 7), generated by straps 41 and 42 and act on clip 10.

Leg 31 is attached to end 18 and is spaced apart from body 30 to form and bound an opening 50 sized to slidably receive the shoulder strap 41 of a brassiere 44. Leg 31 includes front edge 33, rear edge 36, concave arcuate outer surface 14 and convex inner surface 21. The distal end of leg 31 is provided with rounded tip 16.

Leg 32 is attached to end 19 and spaced apart from body 30 to form and bound an opening 51 sized to slidably receive the shoulder strap 42 of a brassiere 44. Leg 32 includes front edge, 34, rear edge 35, concave arcuate outer surface 15 and inner convex surface 22. The distal end of leg 32 is provided with rounded tip 17. Surfaces 14 and 15 preferably, but not necessarily, are shaped and dimensioned to contour and conform to the curvature of the back 45 of a woman wearing clip 10 on straps 41 and 42. During use of clip 10, surfaces 14 and 15 normally contact the back of a woman.

Figure 2:
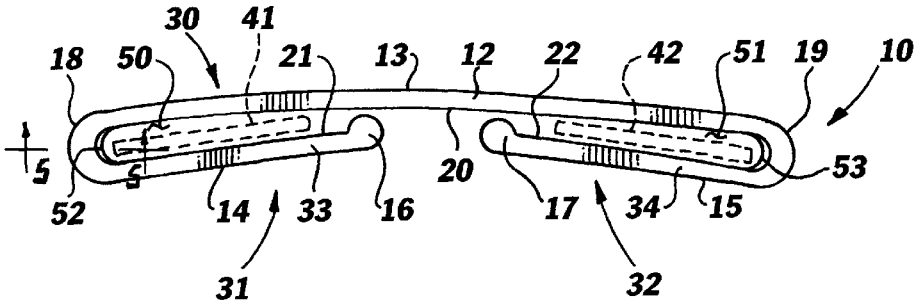
FIG. 2 is a side view of the clip of FIG. 1 illustrating further construction details thereof.
Figure 3:
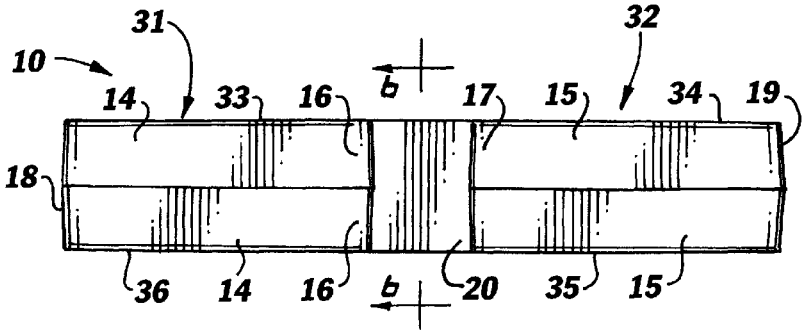
FIG. 3 is a bottom view of the clip of FIG. 1 illustrating further construction details thereof.
Figure 4:
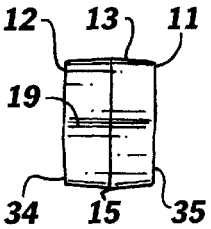
FIG. 4 is a side view of the clip of FIG. 3.
Figure 5:
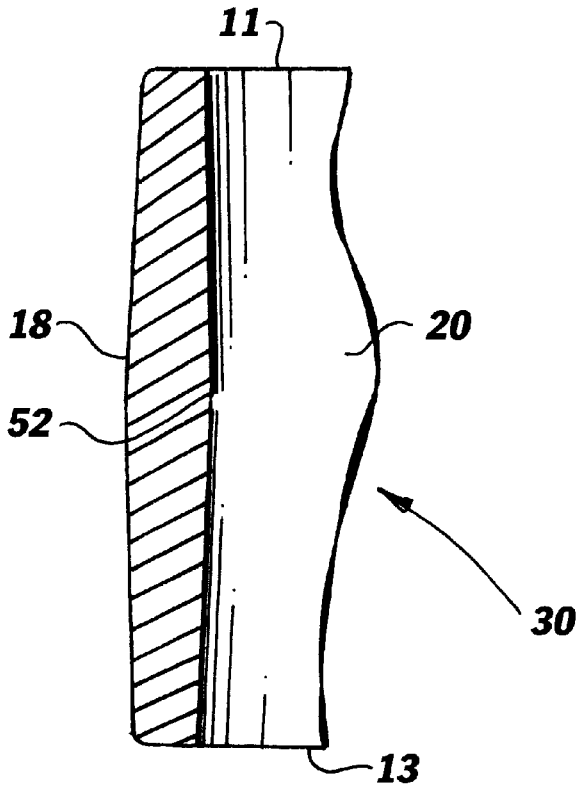
FIG. 5 is a section view of the clip of FIG. 2 taken along section line 5—5 thereof and illustrating further construction details thereof.
Figure 6:
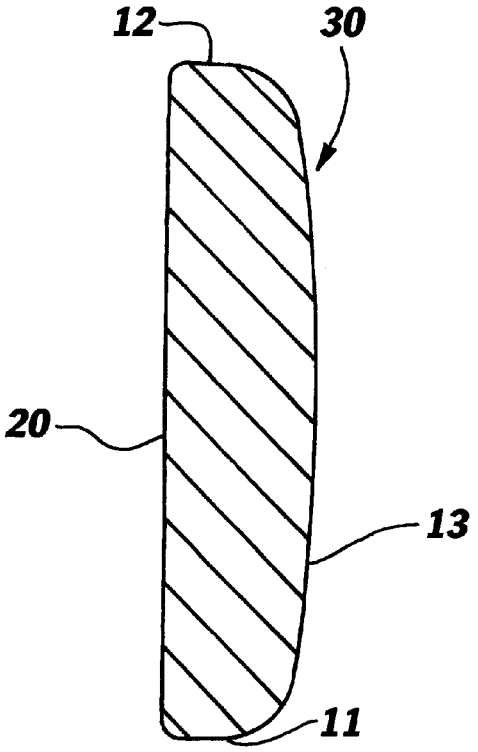
FIG. 6 is a section view of the clip of FIG. 3 taken along section line 6—6 thereof and illustrating further construction details thereof; and, FIG. 7 is a back view of a woman wearing a brassiere with the clip of the invention installed thereon.
Figure 7:
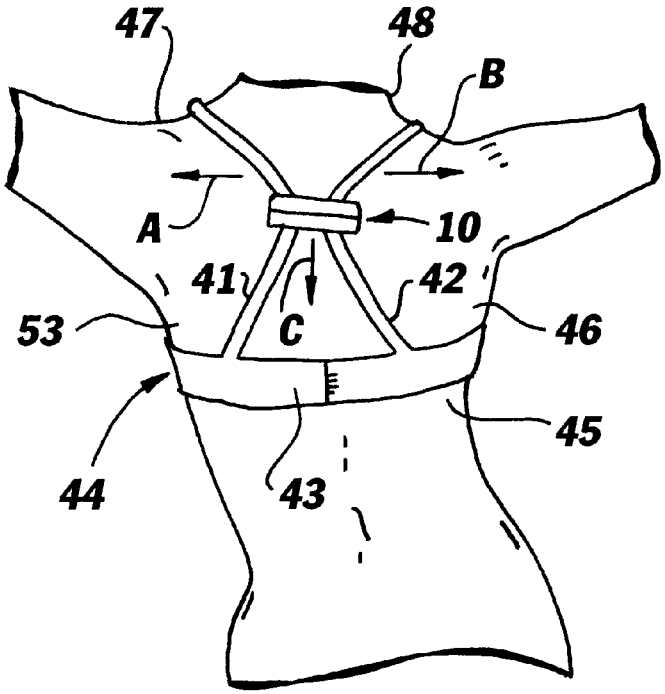

In FIG. 2, the inner convex surface 53 of end 19 extends from top to bottom between inner surface 20 and inner surface 22. Surface 53 also extends front to back from edge 12 to edge 11 and from edge 34 to edge 35. Similarly, the inner convex surface 52 of end 18 extends from top to bottom between inner surfaces 20 and 21. Surface 52 also extends from front to back from edge 12 to edge 11 and from edge 33 to edge 36. The convex shape of surface 52 is also seen in FIG. 5. The convex shape of surfaces 52 and 53 facilitates the sliding of clip 10 down brassiere straps 41 and 42 in the direction of arrow C in FIG. 7 when straps 41 and 42 are pulled apart in the directions indicated by arrows A and B.

In use, a woman puts on a brassiere. The brassiere includes a primary strap 43 which is shaped and dimensioned to extend around her torso. The primary strap 43 includes a front portion (not visible) which extends over and contacts the woman's lower chest and includes a back portion which extends over and contacts the woman's back 45. Strap 43 also extends around and over the sides 46, 53 of the woman's torso in conventional fashion. The bottom of each of a pair of cups (not visible) is attached to the front portion of strap 43. The cups are shaped and dimensioned to receive and support the woman's breasts. A shoulder strap 41 extends from the top of one of the cups over the woman's left shoulder 47 to primary strap 43. Another shoulder strap 42 extends from the top of the other cup over the woman's right shoulder 48 to primary strap 43. The woman manually grasps clip 10 and mounts it on straps 41 and 42 adjacent her upper back. When clip 10 is mounted on straps 41 and 42, strap 41 extends through opening 50 and strap 42 extends through opening 51 in the manner illustrated in FIG. 1. After clip 10 is mounted on straps 41 and 42, the woman manually grasps straps 41 and 42 near her neck and at positions over her upper back. Once straps 41 and 42 are so grasped, the woman pulls them apart in the directions indicated by arrows A and B. Pulling straps 41 and 42 apart in the directions indicated by arrows A and B causes clip 10 to slide down straps 41 and 42 in the directions indicated by arrow C in FIG. 7. The woman can control how far clip 10 travels in the direction of arrow C by how far apart she pulls straps 41 and 42. Further, once clip 10 is positioned on straps 41 and 42, the ability of clip 10 to slide along straps 41 and 42 enables clip 10 to float, or reposition itself, along straps 41 and 42 when the woman engages in sports or other activities in which the orientation of her arms, shoulders, and torso change. As earlier noted, the convex shape of surfaces 52 and 53 facilitate the sliding of clip 10 along straps 41 and 42.

Having described my invention in such terms as to enable those skilled in the art to understand and practice it, and having identified the presently preferred embodiments thereof, I claim:

1. In combination with a brassiere including a primary strap shaped and dimensioned to extend around the torso and having a front portion and a back portion, cup means attached to the front portion of the strap and shaped and dimensioned to support the breasts of a woman wearing the brassiere, a pair of spaced apart shoulder straps each shaped and dimensioned when the brassiere is worn by the woman to extend from the cup means over a different one of the shoulders of the woman to the back portion of the primary strap, the improvements comprising clip means for preventing the shoulder straps from sliding off the shoulders of the woman, said clip means including (a) an elongate body having first and second ends and having a longitudinal axis, said body being substantially rigid and resistant to distension along said longitudinal axis;

(b) a first leg attached to said first end of and spaced apart from said body, said leg and body being shaped and dimensioned to form and bound an opening sized to slidably receive one of the shoulder straps of the brassiere;

(c) a second leg attached to said second end of said body, said leg and body being shaped and dimensioned to form and bound an opening sized to slidably receive the other of the shoulder straps of the brassiere.

2. In combination with a brassiere including a primary strap shaped and dimensioned to extend around the torso and having a front portion and a back portion, cup means attached to the front portion of the strap and shaped and dimensioned to support the breasts of a woman wearing the brassiere, a pair of spaced apart shoulder straps each shaped and dimensioned when the brassiere is worn by the woman to extend from the cup means over a different one of the shoulders of the woman to the back portion of the primary strap, the improvements comprising clip means for preventing the shoulder straps from sliding off the shoulders of the woman, said clip means including (a) an elongate body having first and second ends and having a longitudinal axis;

(b) a first leg attached to said first end of and spaced apart from said body to form and bound a first opening sized to slidably receive one of the shoulder straps of the brassiere;

(c) a second leg attached to said second end of and spaced apart said body, said second leg and body being shaped and dimensioned to form and bound a second opening sized to slidably receive the other of the shoulder straps of the brassiere;

said first and second openings being shaped and dimensioned such that when said clip means is mounted on the brassiere with the shoulder straps each extending through a different one of said first and second openings, pulling the shoulder straps apart causes said clip means to slide along the shoulder straps.

3. In combination with a brassiere including a primary strap shaped and dimensioned to extend around the torso and having a front portion and a back portion, cup means attached to the front portion of the strap and shaped and dimensioned to support the breasts of a woman wearing the brassiere, a pair of spaced apart shoulder straps each shaped and dimensioned when the brassiere is worn by a woman to extend from the cup means over a different one of the shoulders of the woman to the back portion of the primary strap, the improvements comprising clip means for preventing the shoulder straps from sliding off the shoulders of the woman, said clip means including (a) an elongate body having
(i) first and second ends,
(ii) a length; and,
(iii) a longitudinal axis, said length being about equal to the flex distance between the shoulder blades of the woman wearing the brassiere;

(b) a first leg attached to said first end of and spaced apart from said body to form and bound a first opening sized to receive one of the shoulder straps of the brassieres;

(c) a second leg attached to said second end of and spaced apart said body, said second leg and body being shaped and dimensioned to form and bound a second opening sized to receive the other of the shoulder straps of the brassiere.

4. In combination with a brassiere including a primary strap shaped and dimensioned to extend around the torso and having a front portion and a back portion, cup means attached to the front portion of the strap and shaped and dimensioned to support the breasts of a woman wearing the brassiere, a pair of spaced apart shoulder straps each shaped and dimensioned when the brassiere is worn by a woman to extend from the cup means over a different one of the shoulders of the woman to the back portion of the primary strap, the improvements comprising clip means for preventing the shoulder straps from sliding off the shoulders of the woman, said clip means including (a) an elongate body having
(i) first and second ends,
(ii) a length; and,
(iii) a longitudinal axis;

(b) a first leg attached to said first end of and spaced apart from said body to form and bound a first opening sized to receive one of the shoulder straps of the brassiere;

(c) a second leg attached to said second end of and spaced apart from said body, said second leg and body being shaped and dimensioned to form and bound a second opening sized to receive the other of the shoulder straps of the brassiere;

said clip means being shaped and dimensioned to conform to the contour of the woman's back when worn on the brassiere such that the shoulder straps each extend through a different one of said first and second openings.

5. A method for securing a brassiere in a selected position, the brassiere including a primary strap shaped and dimensioned to extend around the torso and having a front portion and a back portion, cup means attached to the front portion of the strap and shaped and dimensioned to support the breasts of a woman wearing the brassiere, a pair of spaced apart shoulder straps each shaped and dimensioned when the brassiere is worn by a woman to extend from the cup means over a different one of the shoulders of the woman to the back portion of the primary strap, the method including the steps of (a) providing clip means including
(i) an elongate body having
first and second ends,
a length, and,
a longitudinal axis;
(ii) a first leg attached to said first end of and spaced apart from said body to form and bound a first opening sized to receive one of the shoulder straps of the brassiere;

(iii) a second leg attached to said second end of and spaced apart from said body, said second leg and body being shaped and dimensioned to form and bound a second opening sized to receive the other of the shoulder straps of the brassiere;

said clip means being shaped and dimensioned to conform to the contour of the woman's back when worn on the brassiere such that the shoulder straps each extend through a different one of said first and second openings;

(b) mounting said clip means on the straps of a brassiere; and, (c) pulling the straps apart to cause said clip means to slide along the straps.

* * * * *